US007735794B1

(12) United States Patent
Gretz

(10) Patent No.: US 7,735,794 B1
(45) Date of Patent: Jun. 15, 2010

(54) ADJUSTABLE FIXTURE MOUNTING BRACKET FOR SUSPENDED CEILING

(75) Inventor: Thomas J. Gretz, Clarks Summit, PA (US)

(73) Assignee: Arlington Industries, Inc., Scraton, PA (US)

( * ) Notice: Subject to any disclaimer, the term of this patent is extended or adjusted under 35 U.S.C. 154(b) by 101 days.

(21) Appl. No.: 11/975,596

(22) Filed: Oct. 19, 2007

Related U.S. Application Data

(63) Continuation-in-part of application No. 11/089,386, filed on Mar. 24, 2005.

(51) Int. Cl.
*B42F 13/00* (2006.01)

(52) U.S. Cl. ..... 248/343; 248/200.1; 248/229.16; 248/906

(58) Field of Classification Search ..... 248/343
See application file for complete search history.

(56) References Cited

U.S. PATENT DOCUMENTS 466,932 A * 1/1892 Cornell ..... 47/46
1,131,059 A * 3/1915 Groffman ..... 248/343
1,156,885 A * 10/1915 Caine ..... 248/218.4
1,213,865 A * 1/1917 Gunn ..... 248/343
1,566,998 A * 12/1925 Tax ..... 248/343
1,576,543 A * 3/1926 Picker ..... 248/343
1,617,184 A * 2/1927 Spott ..... 248/343
2,316,389 A * 4/1943 Atkinson ..... 248/300
2,423,757 A * 7/1947 Dedge ..... 220/3.9
2,642,251 A * 6/1953 Janness ..... 248/343
2,657,442 A * 11/1953 Bedford, Jr. ..... 248/74.2
4,015,811 A * 4/1977 Nute et al. ..... 248/343
4,041,657 A * 8/1977 Schuplin ..... 52/39
4,088,293 A * 5/1978 Delmore ..... 248/500
4,114,327 A * 9/1978 Williams ..... 52/28
4,122,762 A * 10/1978 Williams ..... 454/292
4,700,917 A * 10/1987 Dillman ..... 248/227.4
5,435,514 A 7/1995 Kerr, Jr.
5,619,263 A * 4/1997 Laughlin et al. ..... 248/343
5,934,631 A * 8/1999 Becker et al. ..... 248/200.1
6,098,945 A * 8/2000 Korcz ..... 248/343
6,119,784 A * 9/2000 MacDonald et al. ..... 169/43
6,341,466 B1 * 1/2002 Kehoe et al. ..... 52/712
6,345,800 B1 2/2002 Herst et al.
6,761,341 B2 * 7/2004 Pfaller ..... 248/200.1
2003/0029983 A1 * 2/2003 Pfaller ..... 248/343
2008/0296460 A1 * 12/2008 Kerr, Jr. ..... 248/343

* cited by examiner

*Primary Examiner*—J. Allen Shriver, II
*Assistant Examiner*—Alaeddin Mohseni

(57) ABSTRACT

A fixture support assembly for supporting a lighting or fan fixture on a drop ceiling having a grid supporting structure. The assembly includes a U-shaped bar with an upward directed channel and a channel bottom, two end brackets integral with the bar, a clamp member slidable within the channel, and an electrical box. The end brackets include an inner leg for resting on the horizontal ledges of adjacent T-rails and outer legs for loosely fitting over the top of the T-rails. A slot is provided in the channel bottom extending from one end to slightly past the center of the bar. A fastening arrangement connects the electrical box to the clamp member and in a loosened state enables positioning of the electrical box with respect to the bar.

17 Claims, 11 Drawing Sheets

ADJUSTABLE FIXTURE MOUNTING BRACKET FOR SUSPENDED CEILING

This application is a Continuation-In-Part of U.S. patent application Ser. No. 11/089,386 filed Mar. 24, 2005, still pending.

FIELD OF THE INVENTION

This invention relates to load bearing hangers for overhead electrical boxes and specifically to an improved fixture support assembly for suspended or drop ceilings that can be manufactured at low cost and can be easily installed.

BACKGROUND OF THE INVENTION

An adjustable mounting bracket for supporting electrical fixtures was disclosed in co-pending U.S. application Ser. No. 11/089,386, filed Mar. 24, 2005, which is commonly owned by the assignee of the present invention and the contents of which are incorporated herein in their entirety by reference thereto. The adjustable mounting bracket of U.S. Ser. No. 11/089,386 enabled rapid mounting of an electrical fixture on the T-rails of a drop ceiling with the load suspended from structurally sound portions of the assembly rather than from the electrical box.

The present invention is a fixture support assembly that facilitates rapid hanging of an electrical fixture from the grid arrangement of a suspended or drop ceiling and also is of simplified construction to enable production at low cost.

SUMMARY OF THE INVENTION

The invention is a fixture support assembly for supporting a lighting or fan fixture on a drop ceiling having a grid supporting structure. The assembly includes a U-shaped bar with an upward directed channel and a channel bottom, two end brackets integral with the bar, a clamp member slidable within the channel, and an electrical box. The end brackets include an inner leg for resting on the horizontal ledges of adjacent T-rails and outer legs for loosely fitting over the top of the T-rails. A slot is provided the channel bottom extending from one end to slightly past the center of the bar. A fastening arrangement connects the electrical box to the clamp member and in a loosened state enables positioning of the electrical box with respect to the bar. Sliding of the fastening arrangement with respect to the bar combined with flipping the bar end-to-end enables mounting of the electrical fixture at any desired location between the adjacent T-rails.

OBJECTS AND ADVANTAGES

Several advantages are achieved with the fixture support assembly of the present invention, including:

(1) The fixture support assembly is an assembly of components that can be manufactured at low cost. Many of the parts, including the bar and end brackets, may be stamped and shaped from sheet metal. This lowers the cost of production of the support assembly.

(2) A fastening arrangement including a clamp member that rides within a channel provides an easy aligning feature for rapidly fitting and mounting the assembly between two adjacent T-rails of an overhead grid system.

(3) Ample clearance is provided between the arms and end plate of each end bracket. This enables rapid placement and mounting of the fixture support assembly over the bulb portions of adjacent T-rails in a drop ceiling.

(4) The weight of a lighting or fan fixture is supported by the clamp member rather than by the electrical box. Thus the weight of the suspended fixture is supported by the clamp member and the bar, rather than by the electrical box whose walls are not typically built to bear the weight of a suspended fixture.

These and other objects and advantages of the present invention will be better understood by reading the following description along with reference to the drawings.

Figure 1:
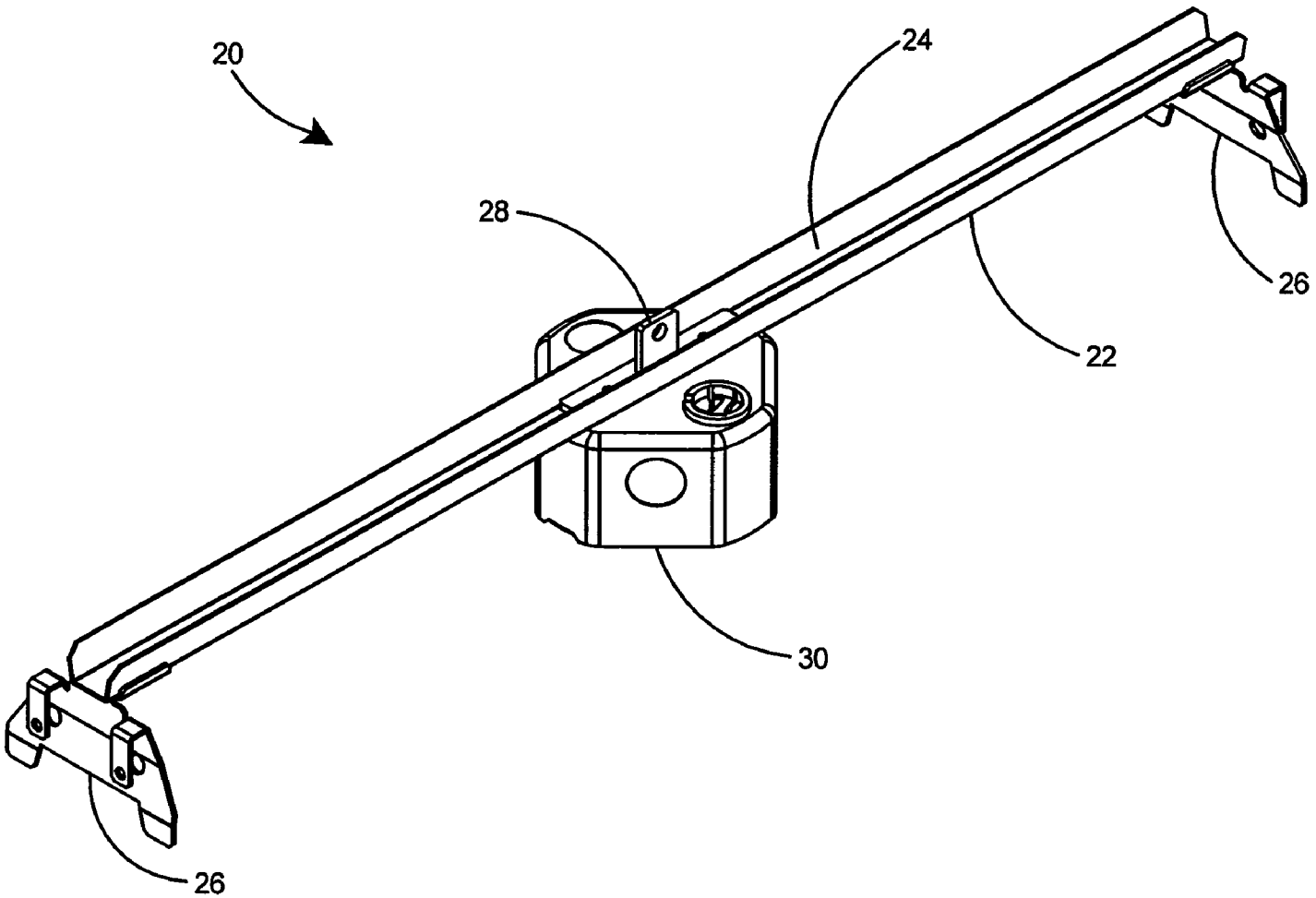
FIG. 1 is a perspective view of a preferred embodiment of a fixture support assembly according to the present invention for supporting a lighting or fan fixture according to the present invention.

Table of Nomenclature
The following is a listing of part numbers used in the drawings along with a brief description:

| Part Number | Description |
|---|---|
| 20 | fixture support assembly |
| 22 | elongated U-shaped bar |
| 24 | central channel |
| 26 | end bracket |
| 28 | clamp member |
| 30 | electrical box |
| 32 | channel bottom |
| 34 | upward extending side of bar |
| 36 | end of bar |

-continued

Table of Nomenclature
The following is a listing of part numbers used in the drawings along with a brief description:

| Part Number | Description |
|---|---|
| 38 | lower surface of bar |
| 40 | midpoint of bar |
| 42 | slot |
| 44 | aperture in channel bottom |
| 46 | end plate of end bracket |
| 48 | arm of end bracket |
| 50 | U-shaped top member |
| 52 | aperture in arm |
| 54 | aperture in top member |
| 56 | aperture in end plate |
| 58 | upward extending side wall on end bracket |
| 60 | end of end plate |
| 62 | downward extending leg of end plate |
| 64 | planar edge |
| 66 | metal blank |
| 68 | bend line |
| 70 | hook portion of end bracket |
| 72 | gap |
| 74 | first portion of end plate |
| 76 | second portion of end plate |
| 78 | pinch point |
| 80 | planar base portion of clamp member |
| 82 | end of base portion |
| 84 | tab portion of clamp member |
| 86 | threaded bore in base portion |
| 88 | aperture in tab |
| 90 | top wall of electrical box |
| 92 | side walls of electrical box |
| 94 | inner enclosure |
| 96 | aperture in top wall |
| 98 | horizontal tab |
| 100 | threaded bore in tab of electrical box |
| 102 | knockout |
| 104 | bottom edge |
| 106 | push-in connector |
| 108 | fastener for connecting end bracket to bar |
| 110 | fastening arrangement |
| 112 | mounting fastener |
| 114 | fixture fastener |
| 116 | T-rail |
| 118 | bulb portion of T-rail |
| 120 | horizontal base of T-rail |
| 122 | stem of T-rail |
| 124 | fastener |
| 126 | aperture in T-rail |
| 127 | top surface of T-rail base |
| 128 | overhead support |
| 130 | turnbuckle |
| 132 | chain |
| 134 | space in end bracket for T-rail |
| θ1 | angle of side wall with respect to channel bottom |
| D1 | distance at pinch point |
| D2 | distance tab extends upward from base portion |
| D3 | offset of tabs from bottom edge of electrical box |
| D4 | thickness of base portion of clamp member |

DETAILED DESCRIPTION OF THE INVENTION

The present invention comprises a fixture support assembly for supporting an electrical fixture, such as a light or fan fixture, on a conventional suspended or drop ceiling.

With reference to FIG. 1, there is shown a preferred embodiment of a fixture support assembly 20 including an elongated U-shaped bar 22 having a central channel 24, an end bracket 26 at each end of the elongated bar 22, a clamp member 28 disposed in the channel 24, and an electrical box 30 secured to the U-shaped bar 22.

Figure 4:
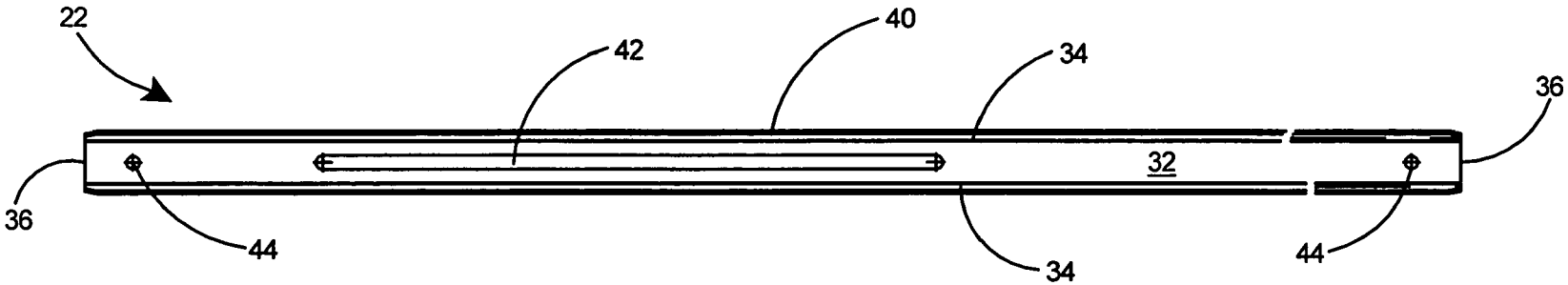
FIG. 4 is a top view of a bar that forms a portion of the fixture support assembly of FIG. 1.
Figure 5:
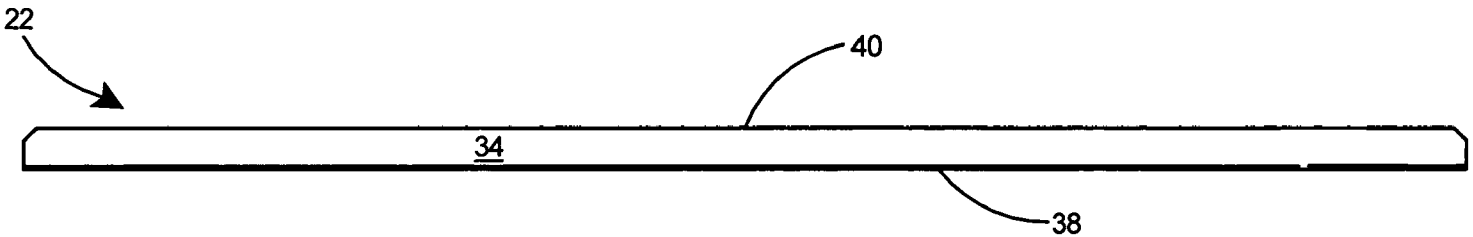
FIG. 5 is a side view of the bar depicted in FIG. 5.
Figure 6:
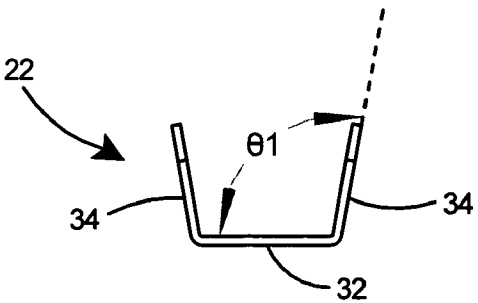
FIG. 6 is an end view of the bar depicted in FIG. 5.

Referring to FIGS. 4-6, the U-shaped bar 22 includes a channel bottom 32, two upward extending sides 34, and two ends 36. The U-shaped bar 22 further includes a lower surface 38, a midpoint 40, and a slot 42 in the channel bottom 32. The slot 42 extends from slightly beyond the midpoint 40 to approximately one end 36 of the bar 22. An aperture 44 is provided therein in the channel bottom 32 approximate each end 36 of the bar 22. As shown in FIGS. 4 and 5, the elongated bar 22 is straight. Preferably, the upward extending sides 34 are each at an angle θ1 of between 95 and 110 degrees with respect to the channel bottom 32.

Figure 7:
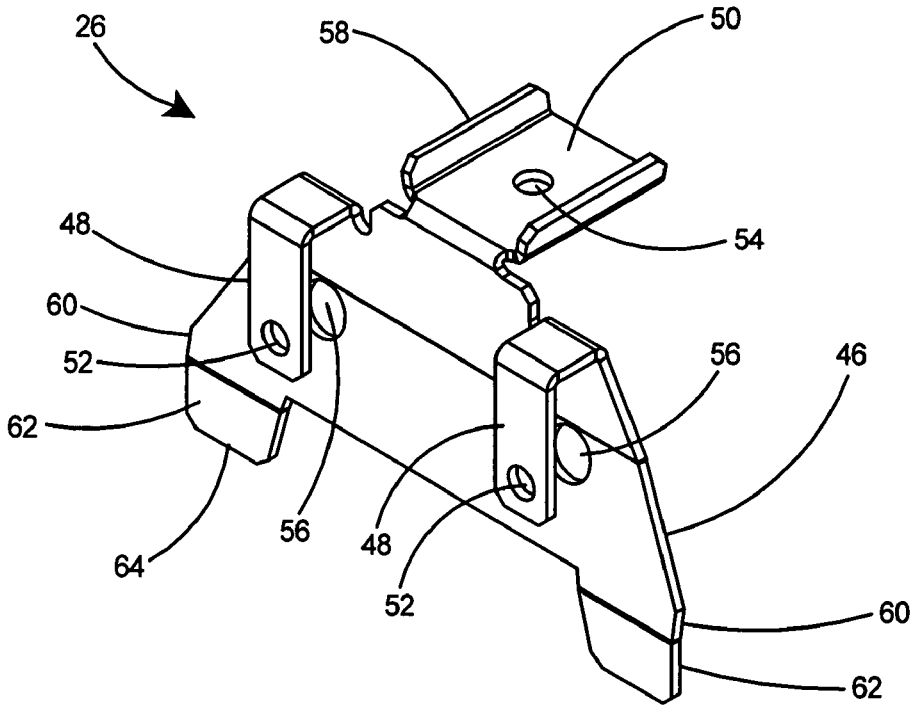
FIG. 7 is a perspective view of an end bracket that forms a portion of the fixture support assembly of FIG. 1.
Figure 8:
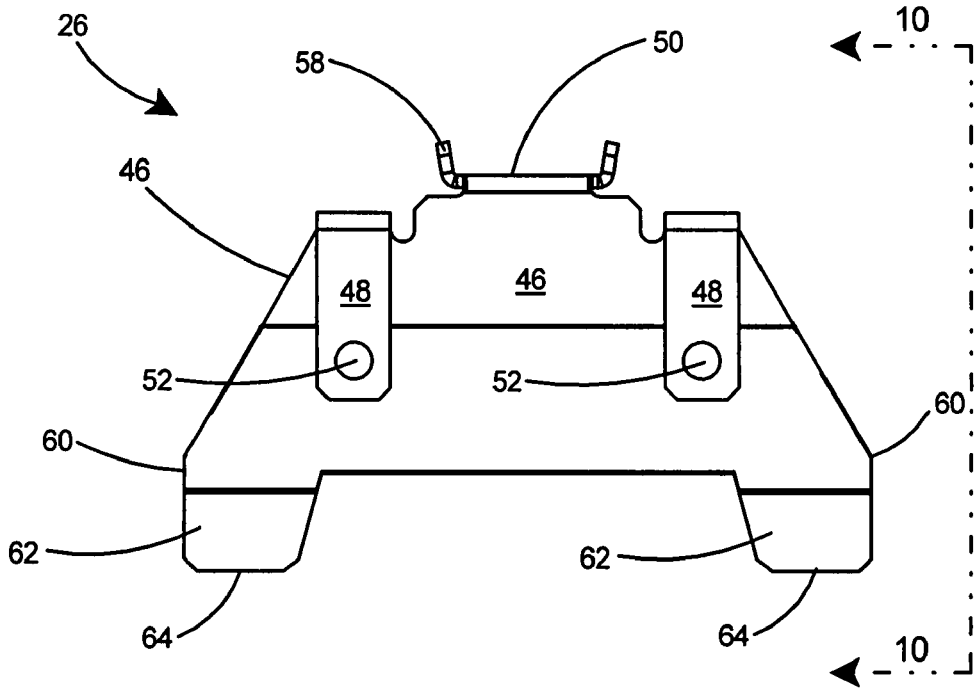
FIG. 8 is a plan view of the fixture support assembly of FIG. 7.

With reference to FIGS. 7 and 8, each end bracket 26 includes an end plate 46, two arms 48 extending outwardly and downwardly from the end plate 46, and a U-shaped top member 50. The end bracket 26 includes an aperture 52 in each of the arms 48, an aperture 54 in the top member 50, and a pair of apertures 56 in the end plate 46 with the apertures 56 in the end plate 46 approximately axial with the apertures 52 in each arm 48. Upward extending side walls 58 are provided on the top member 50 portion of the end bracket 26. The end plates 46 include two ends 60 and a downward extending leg 62 on each of the ends 60. Each of the downward extending legs 62 of the end plates 46 includes a planar or flat bottom edge 64.

Figure 9:
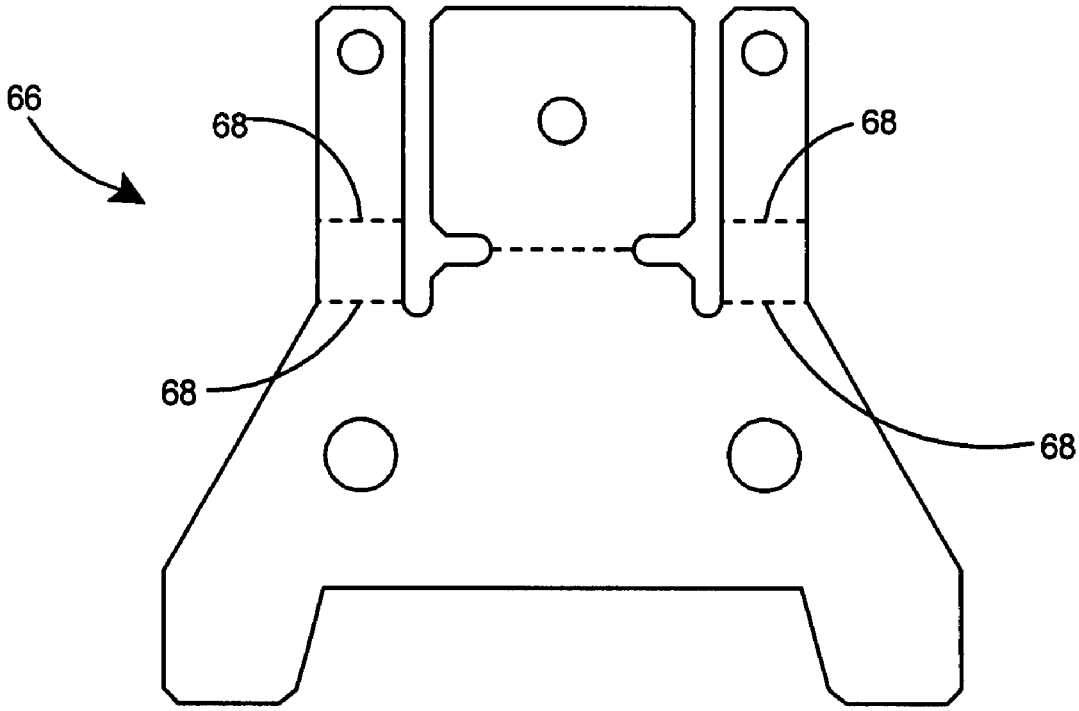
FIG. 9 is a plan view of a blank that is formed into the end bracket of FIG. 7.

With reference to FIG. 9, each end bracket is preferably formed from a metal blank 66. The metal blank 66 is stamped or otherwise formed in the shape shown in FIG. 9 and the blank 66 is bent along bend lines 68 to form the end bracket 26.

Figure 10:
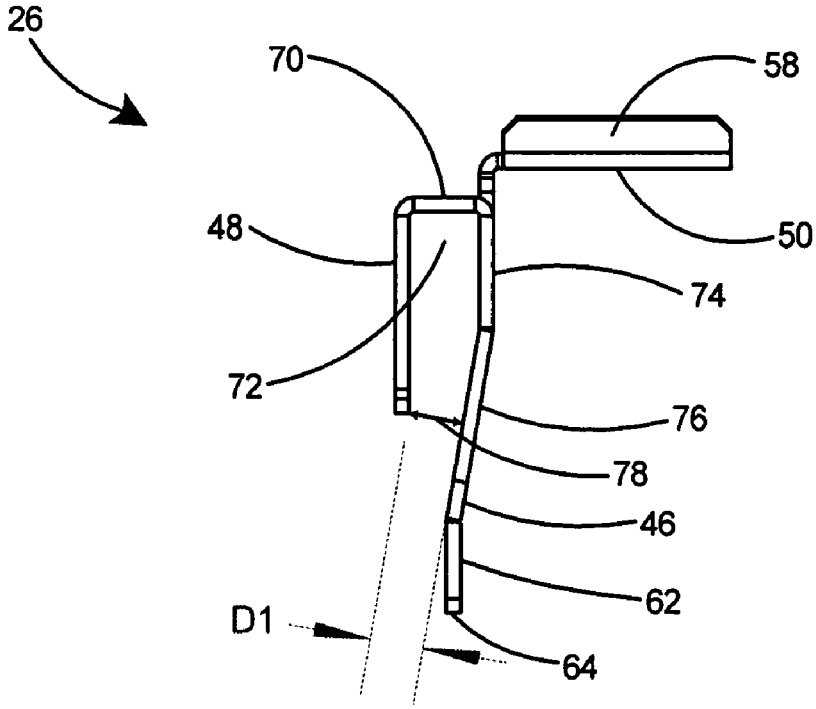
FIG. 10 is a side view of the end bracket as taken from line 10-10 of FIG. 8.

After the blank is bent into the shape of an end bracket 26 as shown in FIG. 10, a hook 70 is formed between the outward and downward extending arm 48 and the end plate 46. The hook 70 includes a gap 72 therein. The end plate 46 further includes a first portion 74 extending perpendicular with respect to the top member 50 and a second portion 76 extending outwardly from the first portion 74. The outward extending second portion 76 creates a pinch point 78 between the end plate 46 and the arm 48.

Figure 11:
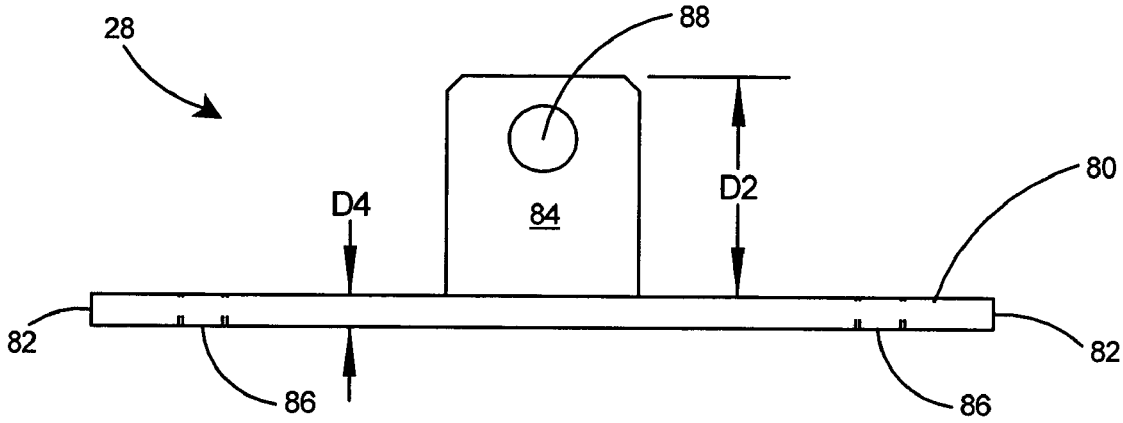
FIG. 11 is a plan view of a clamp member that forms a portion of the fixture support assembly of FIG. 1.
Figure 12:
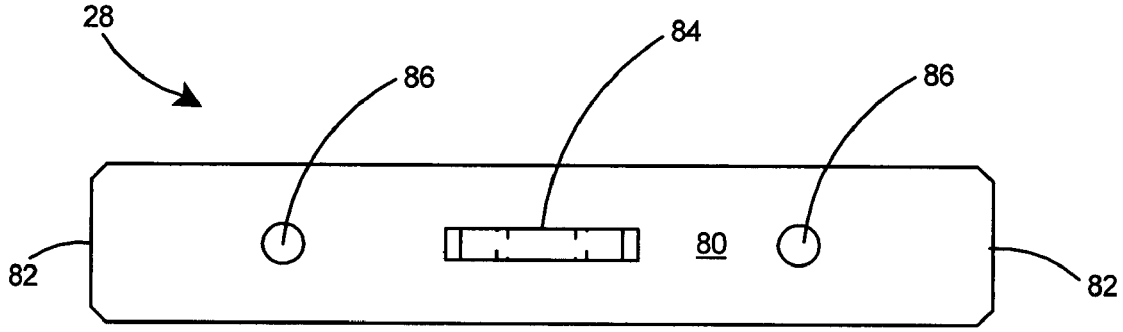
FIG. 12 is a top view of the clamp member of FIG. 11.

Referring to FIGS. 11 and 12, the clamp member 28 includes a planar horizontal base portion 80 having two ends 82 and an upward extending tab 84. Threaded bores 86 are provided in the horizontal base portion 80 of the clamp member 28 approximate the ends 82 and an aperture 88 is provided in the upward extending tab 84. The clamp member 28 is preferably formed of metal. The upward extending tab 84 is typically welded to the base portion 80. Preferably the tab 84 will extend upward from the base portion 80 by a distance D2 to extend the aperture 88 upwards far enough to provide clearance vertically above the upward extending sides 34 of the U-shaped bar 22 (see FIG. 17).

Figure 13:
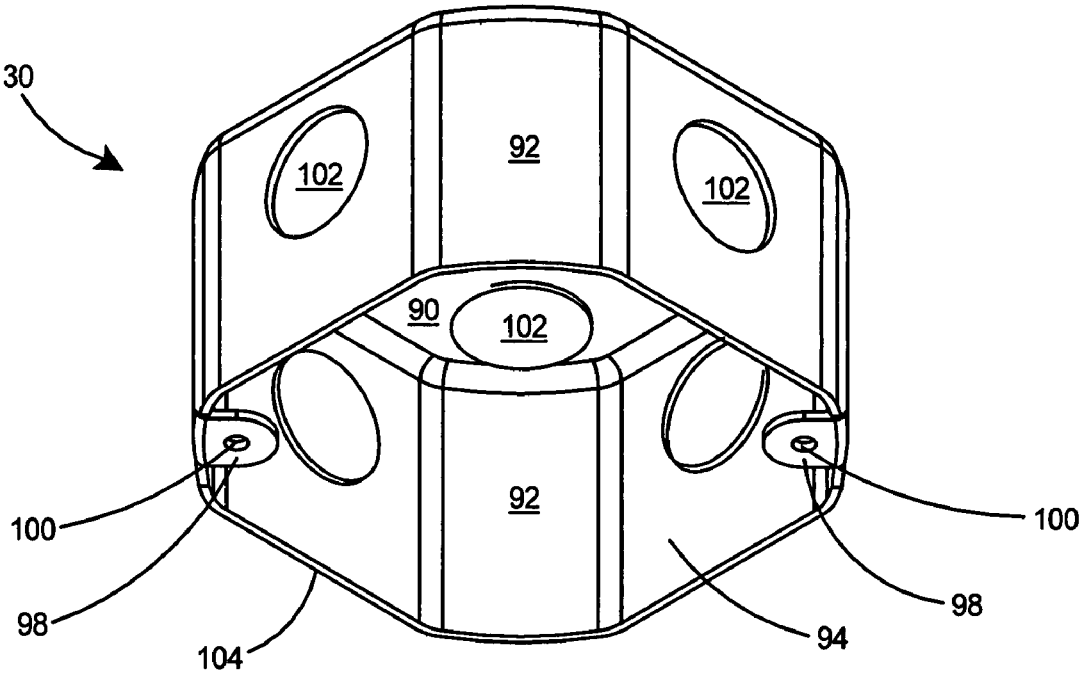
FIG. 13 is a perspective view of an electrical box that forms a portion of the fixture support assembly of FIG. 1.
Figure 14:
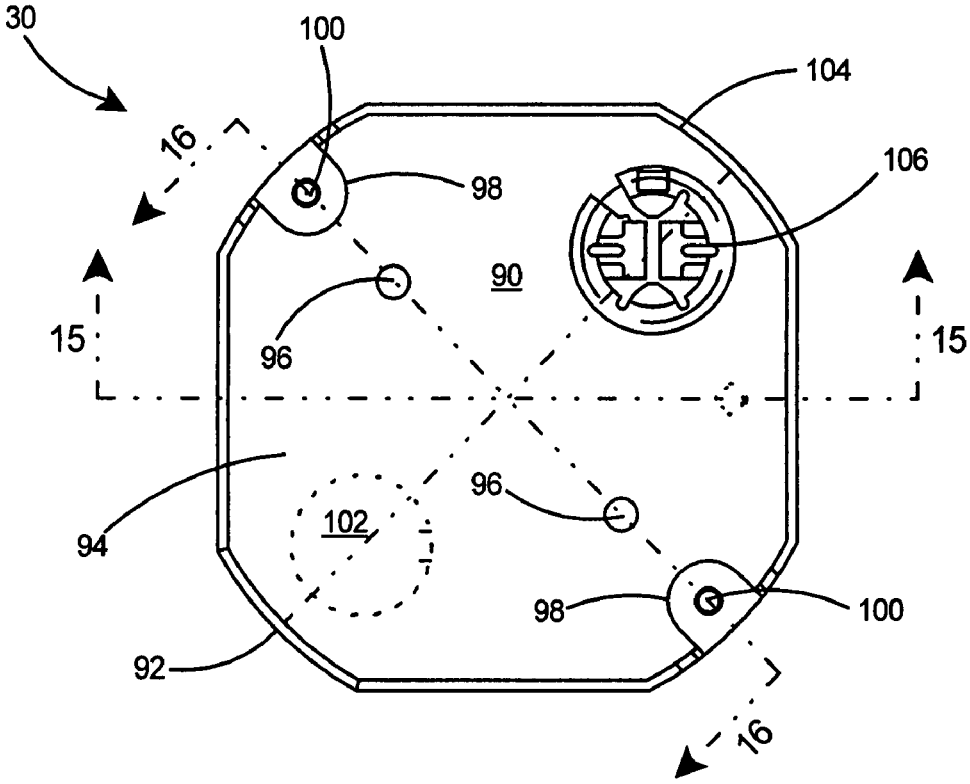
FIG. 14 is a bottom view of the electrical box of FIG. 13.

With reference to FIGS. 13 and 14, the electrical box 30 of the present invention includes a top wall 90, side walls 92, and an inner enclosure 94. Apertures 96 are provided in the top wall 90 of the electrical box and horizontal tabs 98 are provided extending horizontally from the side walls 92 into the inner enclosure 94. The horizontal tabs 98 include threaded bores 100 therein. One or more knockouts 102 are provided in the top wall 90 and the side walls 92 of the electrical box 30. The side walls 92 of the electrical box 30 include a bottom edge 104. The electrical box 30 may include an electrical fitting or connector such as the BLACK BUTTON™ push-in connector 106 for connecting non-metallic cable (not shown) to the electrical box 30. The BLACK BUTTON™ push-in connector, available from Arlington Industries of Scranton, Pa., is simply pushed into one of the knockouts 102 provided in the top wall 90 or side wall 92 of the electrical box 30.

Figure 2:
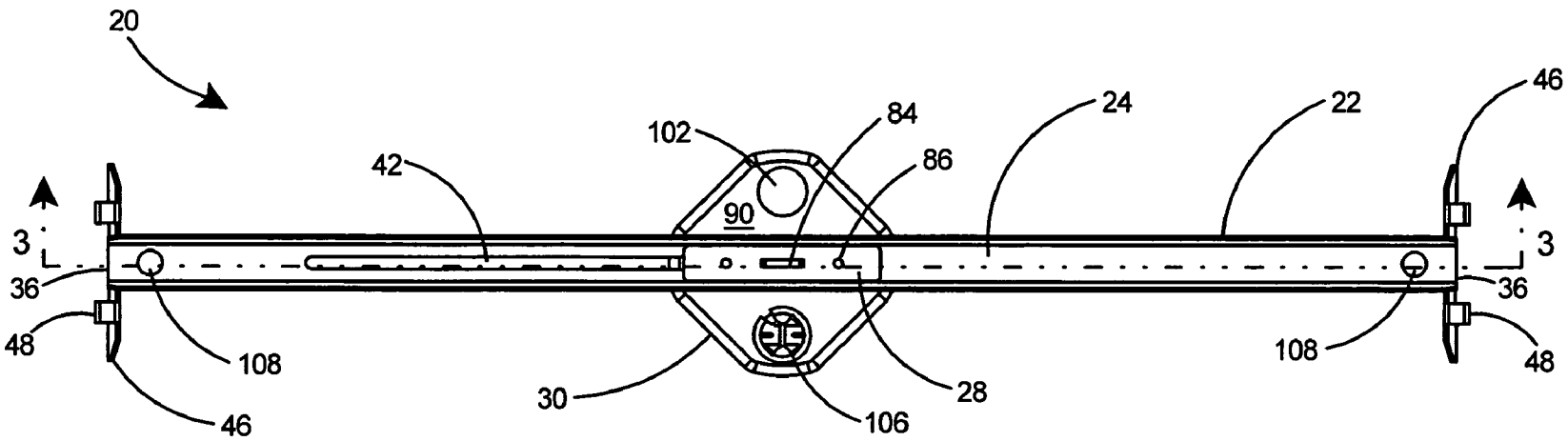
FIG. 2 is a top view of the fixture support assembly of FIG. 1.
Figure 3:
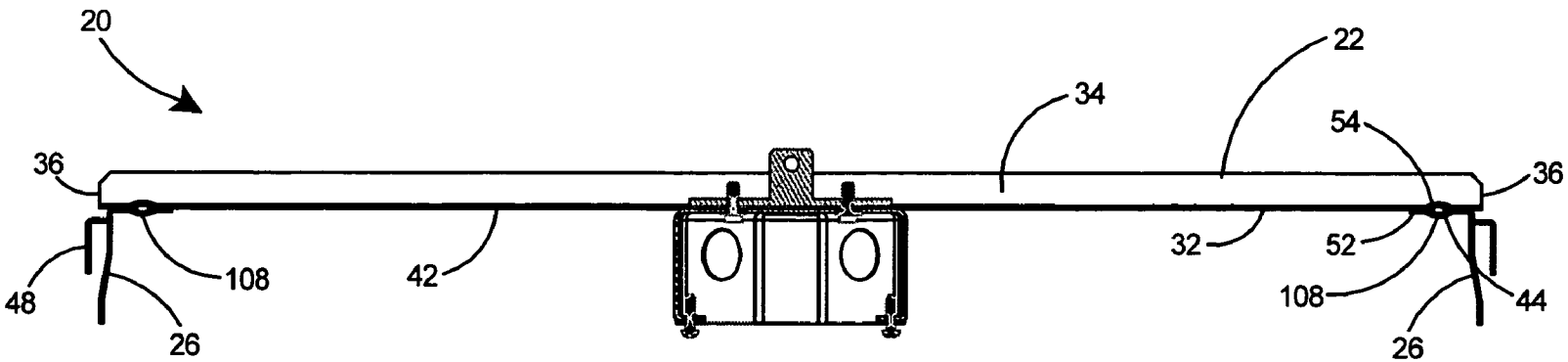
FIG. 3 is a sectional view of the fixture support assembly taken along line 3-3 of FIG. 1.

With reference to FIGS. 2 and 3, a fastener 108 connects each of the end brackets 26 to the ends 36 of the U-shaped bar 22. Preferably, the fastener 108 connecting the end bracket 26 to the bar 22 is a rivet secured through the aperture 44 in the channel bottom 32 of the bar 22 and through the aperture 54 in the top member 50 of the end bracket 26.

Figure 19:
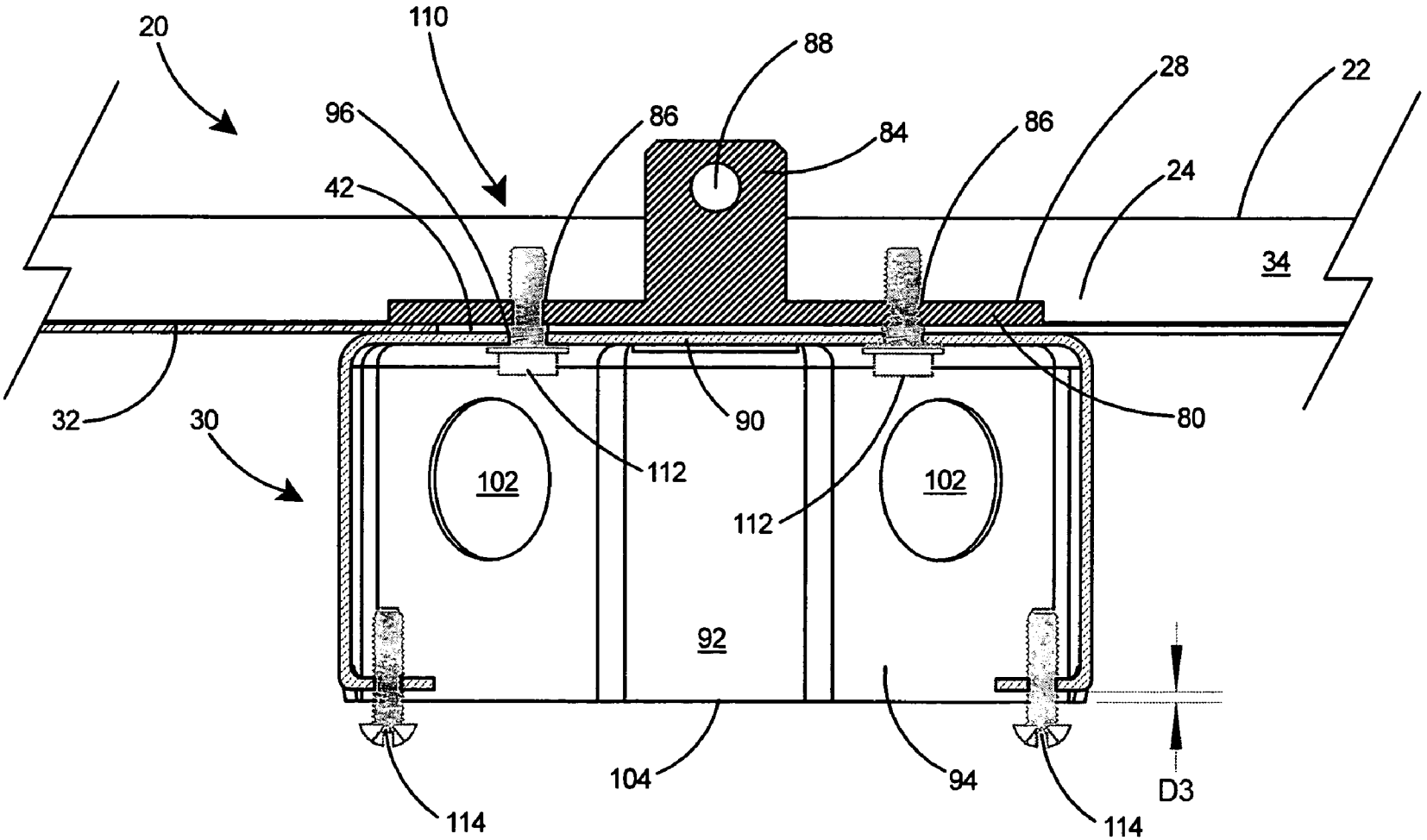
FIG. 19 is a detailed view of the center portion of the fixture support assembly of FIG. 17 including a sectional view of the electrical box secured to the bar.

Referring to FIG. 19, the fixture support assembly 20 of the present invention includes a fastening arrangement 110 for connecting the electrical box 30 to the U-shaped bar 22. The fastening arrangement 110 includes mounting fasteners 112 that extend upward from the inner enclosure 94 of the electrical box 30 through the slot 42 of the bar 22 and into the threaded bores 86 of the clamp member 28. The fastening arrangement 110 includes a loosened state and a secured state. In the loosened state, the mounting fasteners 112 are loosened slightly to render the electrical box 30 slidable with respect to the U-shaped bar 22. In the loosened state, the base portion 80 of the clamp member 28 rides within the channel 24 of the U-shaped bar 22 and the electrical box 30 and clamp member 28 can be slid as an assembly along the length of the slot 42. When the electrical box 30 is positioned in the desired location for a light or fan fixture (not shown), the mounting fasteners 112 are tightened thereby placing the fastening arrangement 110 in the secured state and locking the clamp member 28 and the electrical box 30 to the elongated bar 22.

Figure 17:
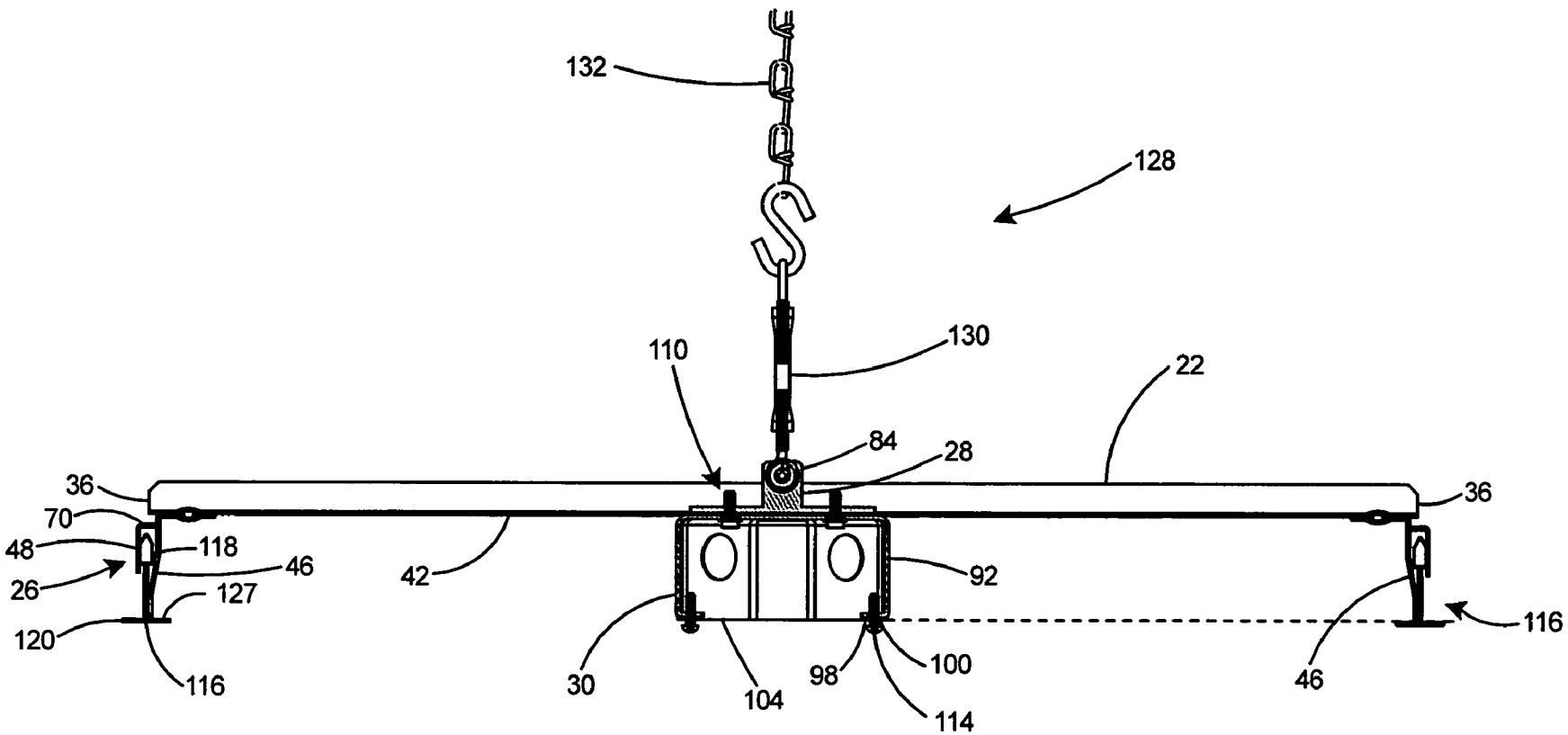
FIG. 17 is a side view of the fixture support assembly of the present invention after being placed over the T-rails of a drop ceiling and having a supporting chain connected thereto.

For an understanding of the operation of the fixture support assembly 20 of the present invention, the reader is referred to FIG. 17. The fixture support assembly 20 is provided in an assembled state with the end brackets 26 secured to each end 36 of the U-shaped bar 22 and the electrical box 30 secured to the bar 22 by the fastening arrangement 110. Fixture fasteners 114 are provided in threaded bores 100 within the horizontal tabs 98 of the electrical box 30. All the fasteners required to secure the fixture support assembly to adjacent T-rails 116 of a suspended ceiling grid structure are therefore provided with the assembly. If the electrical fixture (not shown) is to be installed at a position that is off-center of the adjacent T-rails 116, the installer may need to flip the bar 22 end-to-end to position the slot 42 on the correct side for the off-center mounting. The fastening arrangement 110 may then be adjusted in the manner described above to place the electrical box 30 at the desired position along the U-shaped bar 22. The fixture support assembly 20 is then lifted through the space between the selected T-rails 116 of the ceiling grid structure, raised above the grid structure and then lowered until the hook portions 70 of the end brackets 26 drop onto and engage the adjacent T-rails 116.

Figure 18:
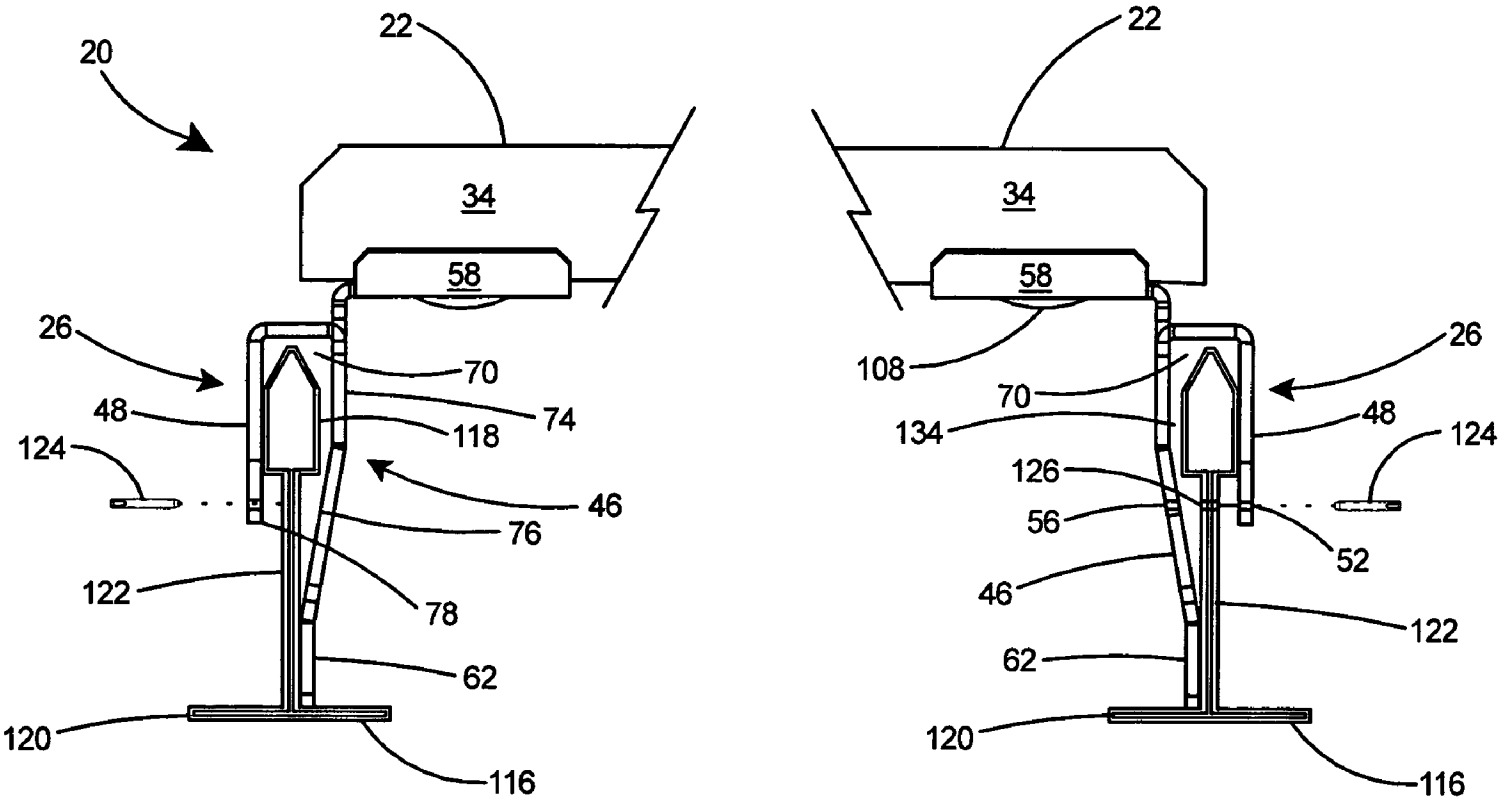
FIG. 18 is a detailed view of the ends of the fixture support assembly of FIG. 17 including a detailed view of the end brackets engaging adjacent T-rails.

As shown in FIG. 18, after the end brackets 26 are engaged on the T-rails 116, the pinch point 78 provides a tortuous path that prevents the fixture support assembly 20 from being easily knocked off of the T-rails 116. Preferably the pinch point 78 (see FIG. 10) is a distance D1 that is between 0.01 and 0.03 inch less than the bulb portion 118 of a T-rail 116 enabling deflection of the end plate 46 when the arms 48 of the end bracket 26 are placed over the bulb portion 118. As shown in FIG. 18, the bulb portions 118 of the T-rails 116 are completely enclosed within the hook portion 70 of the end brackets 26, between the end plates 46 and arms 48 of the end brackets 26. The outward bent second portion 76 of the end plate 46 ensures that the downward extending legs 62 of the end plate 46 will rest solidly on the horizontal base 120 of the T-rail 116 near its juncture with the stem 122 portion of the T-rail. The upward extending side wall 58 on the end bracket 26 engages the sides 34 of the U-shaped bar 22 and thereby act to prevent undesirable twisting of the bar 22 with respect to the end brackets 26. Fasteners 124, such as set screws or the equivalent, may be inserted through the apertures 52 in the arms 48 of the end bracket 26 or through apertures 56 in the end plates 46 to further secure the fixture support assembly 20 to the ceiling grid structure. Apertures 126 may be drilled in the stem 122 of the T-rails 116 if desired to receive the fasteners 124.

With reference to FIG. 17, after the fixture support assembly 20 is secured to the adjacent T-rails 116, the bottom edge 104 of the side walls 92 of the electrical box 30 are substantially level with the top surface 127 of the horizontal base portion 120 of the T-rails 116. Therefore, when the ceiling panels (not shown) are later laid in the opening between the adjacent T-rails 116, the panel's bottom surface will be approximately level with the bottom edge 104 of the electrical box 30.

With the electrical box 30 mounted in the desired location between the T-rails 116, as shown in FIG. 17, an overhead support 128 such as a cable (not shown) or a turnbuckle 130 and chain 132 may be connected to the tab portion 84 of the clamp member 28. The overhead support 128, which is required by some electrical codes for heavy fixtures such as fans, is secured at its top end to some structurally sound portion of the building.

With reference to FIG. 18, the fixture support assembly 20 of the present invention facilitates rapid mounting of an electrical fixture on the T-rails 116 of a suspended ceiling. One of the features of the fixture support assembly 20 that enables rapid mounting to the T-rails 116 includes the ample space 134 provided between the end plate 46 and arm 48 portions of the end brackets 26. Many prior art hanger assemblies include gripping fingers, which do not easily fit over the bulb 118 portion of the T-rails 116 and frequently must be pried apart to fit thereon. The end brackets 26 of the present invention are provided with ample spacing to enable simple dropping of the fixture support assembly 20 over the T-rails 116, which is an advantage to an installer whom usually is on a ladder. An installer would typically find it necessary and inconvenient to reposition the ladder in order to spread the gripping fingers of a prior art hanger apart to fit the hanger on the T-rails.

Referring to FIGS. 11 and 12, the clamp member 28 of the fixture support assembly includes the threaded bores 86 in the base portion 80 which will receive mounting fasteners 112 (see FIG. 19) for supporting the load of an electrical fixture (not shown). The base portion 80 of the clamp member 28 preferably includes a thickness D4 between 0.110 and 0.130 inch to enable the fixture support assembly of the present invention to support heavy loads. As shown in FIG. 19, the base portion 80 of the clamp member 28 bears against the channel bottom 32 that surrounds the slot 42. Therefore, the load is advantageously supported by the clamp member 28 and elongated bar 22 rather than by the electrical box 30. The apertures 96 in the top wall 90 of the electrical box 30 are preferably sized larger than the mounting fasteners 112, allowing the fasteners 112 to pass through and engage the clamp member 28 and thereby enabling the load to be supported by the clamp member 28 and bar 22 and not directly by the electrical box 30.

Figure 15:
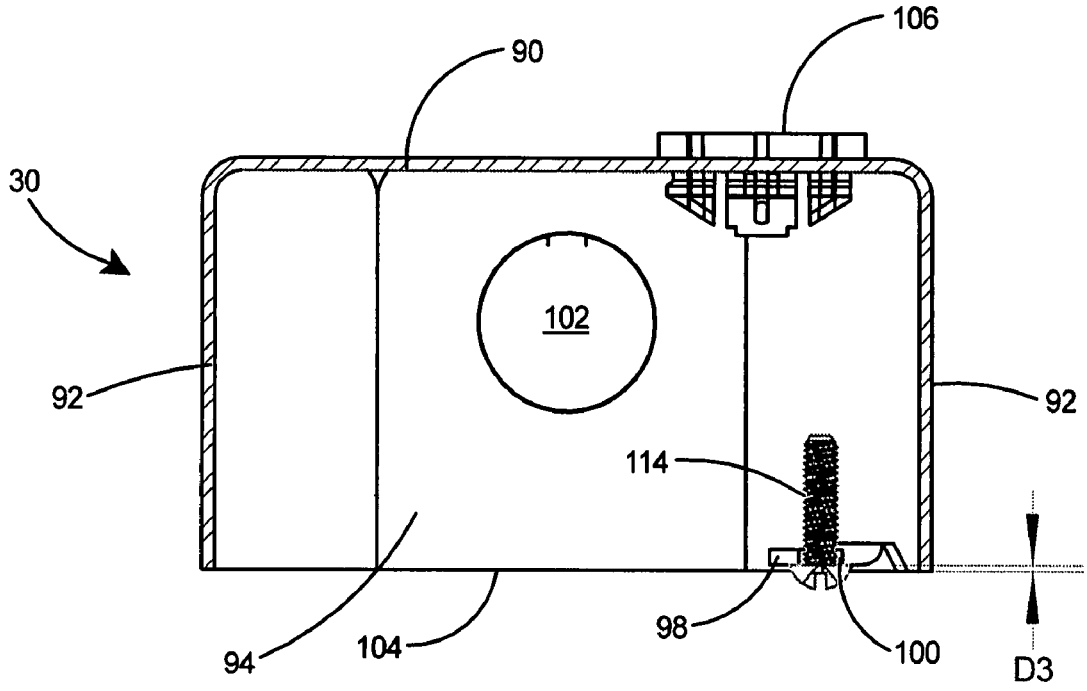
FIG. 15 is a sectional view of the electrical box as taken along line 15-15 of FIG. 14.
Figure 16:
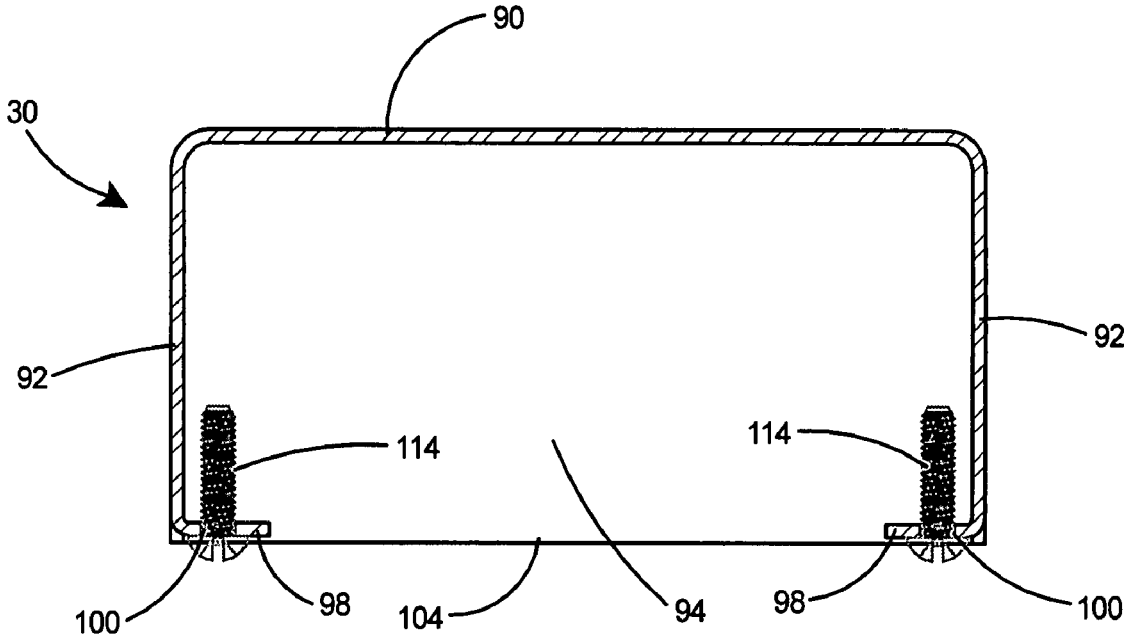
FIG. 16 is a sectional view of the electrical box as taken along line 16-16 of FIG. 14.

With reference to FIGS. 15 and 16, the horizontal tabs 98 of the electrical box 30 are preferably offset by distance D3 from the bottom edge 104 of the electrical box 30. This enhances the attractiveness of the installed electrical fixture by placing the mounting plate (not shown) of the electrical fixture approximately level with the panel of the suspended ceiling.

With reference to FIG. 1, the U-shaped bar 22, end brackets 26, and clamp member 28 of the fixture support assembly 20 are all preferably constructed of metal. An especially preferred material of construction is galvanized 1010 stainless steel.

Having thus described the invention with reference to a preferred embodiment, it is to be understood that the inven-tion is not so limited by the description herein but is defined as follows by the appended claims.

What is claimed is:

1. A fixture support assembly for supporting a lighting or fan fixture on a drop ceiling comprising:

an elongated U-shaped bar having a central channel, a channel bottom, a lower surface, a midpoint, two ends, and two upward extending sides;

a single slot in said channel bottom of said bar, said slot extending from slightly beyond said midpoint to approximate one of said ends of said bar;

an end bracket at each end of said bar;

said end bracket including an end plate perpendicular with respect to said bar and two arms extending outwardly and downwardly from said end plate;

said outward and downward extending arm creating a hook thereon said end bracket;

said hook including a gap therein, said gap of a size greater than the bulb portion of a T-rail enabling said hook to loosely fit over the T-rail when placed thereon;

an elongated clamp member disposed in said channel, said clamp member including a planar horizontal base portion resting on said channel bottom and spanning between said upward extending sides of said U-shaped bar and a planar tab extending upward from and centered on said base portion, said tab extending lengthwise along said base portion;

two threaded bores in said horizontal base portion of said clamp member approximate said ends, said bores aligned along the longitudinal center of said base portion;

an electrical box having a top wall, side walls, and an inner enclosure;

a fastening arrangement connecting said electrical box to said bar, said fastening arrangement including threaded mounting fasteners extending upward from said electrical box inner enclosure through said slot of said bar and into said base portion of said clamp member;

said fastening arrangement including a loosened state and a secured state, said loosened state including said electrical box supported by said mounting fasteners extending through said slot and threaded loosely into said clamp member;

said fastening arrangement in said loosened state enables sliding of said clamp member and said electrical box along said channel while maintaining orientation of said electrical box with respect to said elongated bar; and said fastening arrangement in said secured state locking said clamp member and said electrical box to said elongated bar.

2. The fixture support assembly of claim 1 wherein said upward extending sides are each at an angle of between 95 and 110 degrees with respect to said channel bottom.

3. The fixture support assembly of claim 1 wherein said end bracket includes a U-shaped top member on said end bracket for engaging said lower surface of said U-shaped bar;

a fastener connecting said end bracket to said bar.

4. The fixture support assembly of claim 3 wherein said top member includes an aperture therein;

said end of said bar includes an aperture therein; and said fastener connecting said end bracket to said bar is a rivet secured through said aperture in said end of said bar and through said aperture in said top member of said end bracket.

5. The fixture support assembly of claim 1 wherein said bar is straight.

6. The fixture support assembly of claim 1 wherein each of said arms of said end bracket include apertures therein; and said apertures in said arms are for receipt of fasteners for securing through apertures in the T-rails of the grid structure of a suspended ceiling.

7. The fixture support assembly of claim 1 wherein said end plates include two ends; and a downward extending leg on each of said ends of said end plates.

8. The fixture support assembly of claim 7 wherein each of said downward extending legs of said end plates include a planar bottom edge.

9. The fixture support assembly of claim 1 wherein said gap is between 0.03 and 0.07 inch greater than the bulb portion of said T-rail.

10. The fixture support assembly of claim 1 wherein said end plate includes a first portion extending perpendicular with respect to said bar and a second portion extending outwardly from said first portion;

said outward extending second portion creating a pinch point between said end plate and said arm; and said pinch point being between 0.01 and 0.03 inch less than the bulb portion of a T-rail enabling deflection of said end plate when said arms of said end bracket are placed over the bulb portion of a T-rail.

11. The fixture support assembly of claim 1 including an aperture in said tab of said clamp member.

12. The fixture support assembly of claim 1 wherein said electrical box includes apertures in said top wall of said electrical box;

horizontal tabs extending into said inner enclosure from said side walls of said electrical box, said horizontal tabs including apertures therein; and one or more knockouts in said top wall and side walls of said electrical box.

13. The fixture support assembly of claim 1 wherein said side walls of said electrical box include a bottom edge; and said bottom edge of said side walls of said electrical box are substantially level with the top surface of the base portion of a T-rail of a suspended ceiling structure.

14. The fixture support assembly of claim 12 including fasteners for securing an electrical fixture to said horizontal tabs of said electrical box.

15. The fixture support assembly of claim 11 including a turnbuckle having an upper and a lower end; and said lower end of said turnbuckle pivotally attached to said tab of said clamp member.

16. The fixture support assembly of claim 1 wherein said fastening arrangement includes apertures in said top wall of said electrical box and threaded bores in said clamp member, and said mounting fasteners extend upward from said electrical box inner enclosure through said apertures in said top wall of said electrical box, through said slot of said bar, and into said threaded bores in said clamp member.

17. The fixture support assembly of claim 12 wherein said side walls of said electrical box include a bottom edge; and said horizontal tabs are offset a slight distance from said bottom edge of said electrical box.

* * * * *